US007418892B2

(12) United States Patent
Taylor

(10) Patent No.: US 7,418,892 B2
(45) Date of Patent: Sep. 2, 2008

(54) DETACHABLE WRENCH HANDLE ASSEMBLY

(75) Inventor: Michael K. Taylor, Alamo, TN (US)

(73) Assignee: Black & Decker Inc., Newark, DE (US)

( * ) Notice: Subject to any disclaimer, the term of this patent is extended or adjusted under 35 U.S.C. 154(b) by 61 days.

(21) Appl. No.: 10/293,749

(22) Filed: Nov. 13, 2002

(65) Prior Publication Data

US 2006/0075854 A1 Apr. 13, 2006

Related U.S. Application Data

(60) Provisional application No. 60/400,490, filed on Aug. 2, 2002.

(51) Int. Cl.
*B25B 23/16* (2006.01)
*B25G 1/08* (2006.01)
*B25F 1/00* (2006.01)

(52) U.S. Cl. ..... 81/177.1; 81/177.2; 16/426; 7/167

(58) Field of Classification Search ..... 81/177.1, 81/177.2, 177.4, 177.85, 489, 490; 7/167, 7/168; 451/451, 454, 344, 353, 358, 359; D8/67–70; 16/422, 426, 431, 436, 444; 408/241 R
See application file for complete search history.

(56) References Cited

U.S. PATENT DOCUMENTS

D136,188 S * 8/1943 Payne ..... D8/22
3,376,768 A * 4/1968 Fortunato ..... 81/177.2
4,462,728 A * 7/1984 Sturgis ..... 408/241 R
4,530,262 A * 7/1985 Pownall ..... 81/177.9
4,820,090 A * 4/1989 Chen ..... 81/177.4
4,891,915 A * 1/1990 Yasuda ..... 451/359
4,945,790 A * 8/1990 Golden ..... 81/57.14
5,810,525 A * 9/1998 Ector, Sr. ..... 408/241 R
5,813,805 A * 9/1998 Kopras ..... 408/241 R
5,931,066 A * 8/1999 Waynick ..... 81/177.2
6,048,260 A * 4/2000 Kopras ..... 451/358
D442,452 S * 5/2001 Stirm et al. ..... D8/67
6,443,675 B1 * 9/2002 Kopras et al. ..... 409/182

FOREIGN PATENT DOCUMENTS

JP 04331080 A * 11/1992
JP 2002 205 285 * 7/2002
JP 2002205285 A * 7/2002

* cited by examiner

*Primary Examiner*—Hadi Shakeri
(74) *Attorney, Agent, or Firm*—Mehul R. Jani; Adan Ayala

(57) ABSTRACT

The present invention is directed to a detachable handle assembly for providing a mechanical device capable of utilization in securing and un-securing a work attachment, such as a blade or bit, to a hand-tool. The assembly includes a body portion for grasping, when implemented as an auxiliary handle for a hand-tool such as a power tool or a pneumatic tool.

8 Claims, 4 Drawing Sheets

DETACHABLE WRENCH HANDLE ASSEMBLY

CROSS REFERENCE

The present application claims priority to U.S. Provisional Patent Ser. No. 60/400,490, entitled: Detachable Wrench Handle Assembly, filed on Aug. 2, 2002 which is hereby incorporated in its entirety.

FIELD OF THE INVENTION

The present invention relates to the field of hand tools and particularly to an apparatus for providing a detachable handle capable of utilization for tool disassembly/assembly.

BACKGROUND OF THE INVENTION

Tools such as power tools, pneumatic tools and the like often require a mechanical device to change attachments. For example, angle grinders typically include a wrench for removing grinding blades, wire brushes and the like. Spanner wrenches, a wrench with two protrusions extending generally perpendicular from the plane of the wrench, are used for changing attachments such as various blades, brushes, and the like on a grinder. The protrusions are designed to fit into a securing collar or the like for securing the attachment to the tool.

Providing a separate mechanical device for changing attachments may result in the device becoming lost, forgotten, or misplaced. As a result, the mechanical device must be retrieved or replaced in order to change the tool's capability. In some instances, the mechanical device is secured to the tool or in the case of a power tool, to the tool's cord, such as by a chain, cord or the like to prevent loss. A mechanical device secured in the previous manner to a hand-held tool may hinder the user and interfere with operation of the tool.

Moreover, mechanical devices add to the overall cost of the hand tool. In order to minimize expense, tool manufactures may provide only inexpensively made mechanical device. For instance, spanner wrenches typically have a Y-shaped flat body with protrusions for engaging a securing collar. As a result of the desire to minimize cost, mechanical devices such as spanner wrenches are often uncomfortable or unwieldy.

Therefore, it would be desirable to provide a detachable wrench handle assembly apparatus capable of dual utilization as a mechanical device and a detachable handle for user manipulation.

SUMMARY OF THE INVENTION

Accordingly, the present invention is directed to an assembly capable of functioning as a detachable handle and functioning as a mechanical device for adjusting the hand tool's work attachment such as a bit, a blade and the like.

In an aspect of the invention, a handle assembly includes a body portion, an attachment device, and a mechanical device. The attachment device is mounted to the body portion and is suitable for connecting the assembly to a hand held tool. A mechanical device may be coupled to the handle or the attachment device. The mechanical device may be suited for adjusting, such as securing and un-securing, a work attachment to the hand tool.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DESCRIPTION OF THE INVENTION

Reference will now be made in detail to the presently preferred embodiments of the invention, examples of which are illustrated in the accompanying drawings.

Referring generally now to FIGS. 1 through 4, exemplary embodiments of the present invention are shown. The assembly of the present invention overcomes the inconvenience of a separate device for adjusting a hand-held tool. For instance, a user may be less apt to misplace a handle assembly than a separate wrench.

Figure 1:
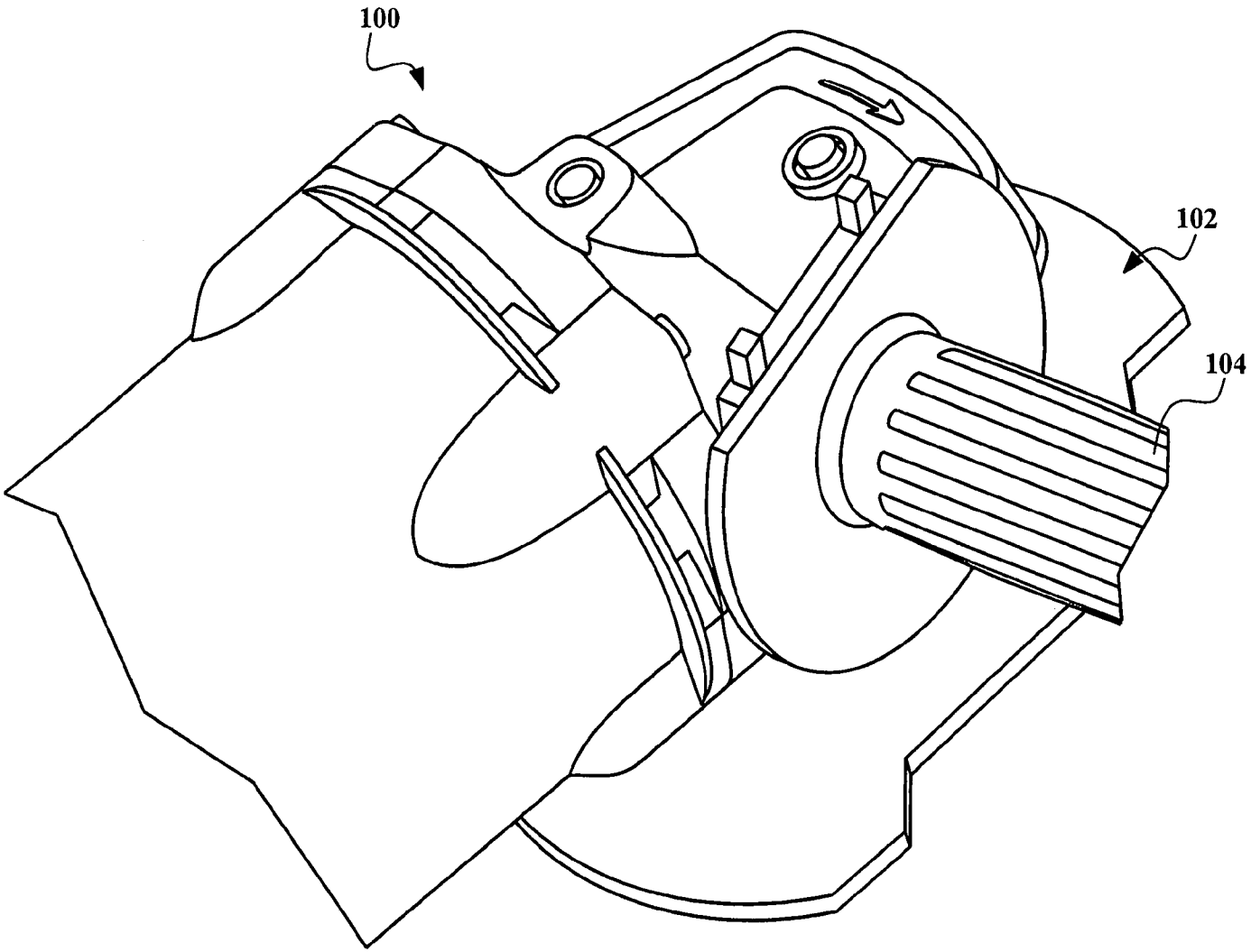
FIG. 1 is a perspective view of a handle assembly utilized in conjunction with a angle grinder.

Referring to FIG. 1, a handle assembly 102 is implemented with an angle grinder 100. The assembly 102 may be implemented as an auxiliary handle to a hand-held tool, such as a drill, a grinder, a planer, a router, a reciprocating saw and the like. The assembly 102 includes a body portion 104. For example, the body 104 is generally cylindrical to permit easy grasping.

Figure 2:
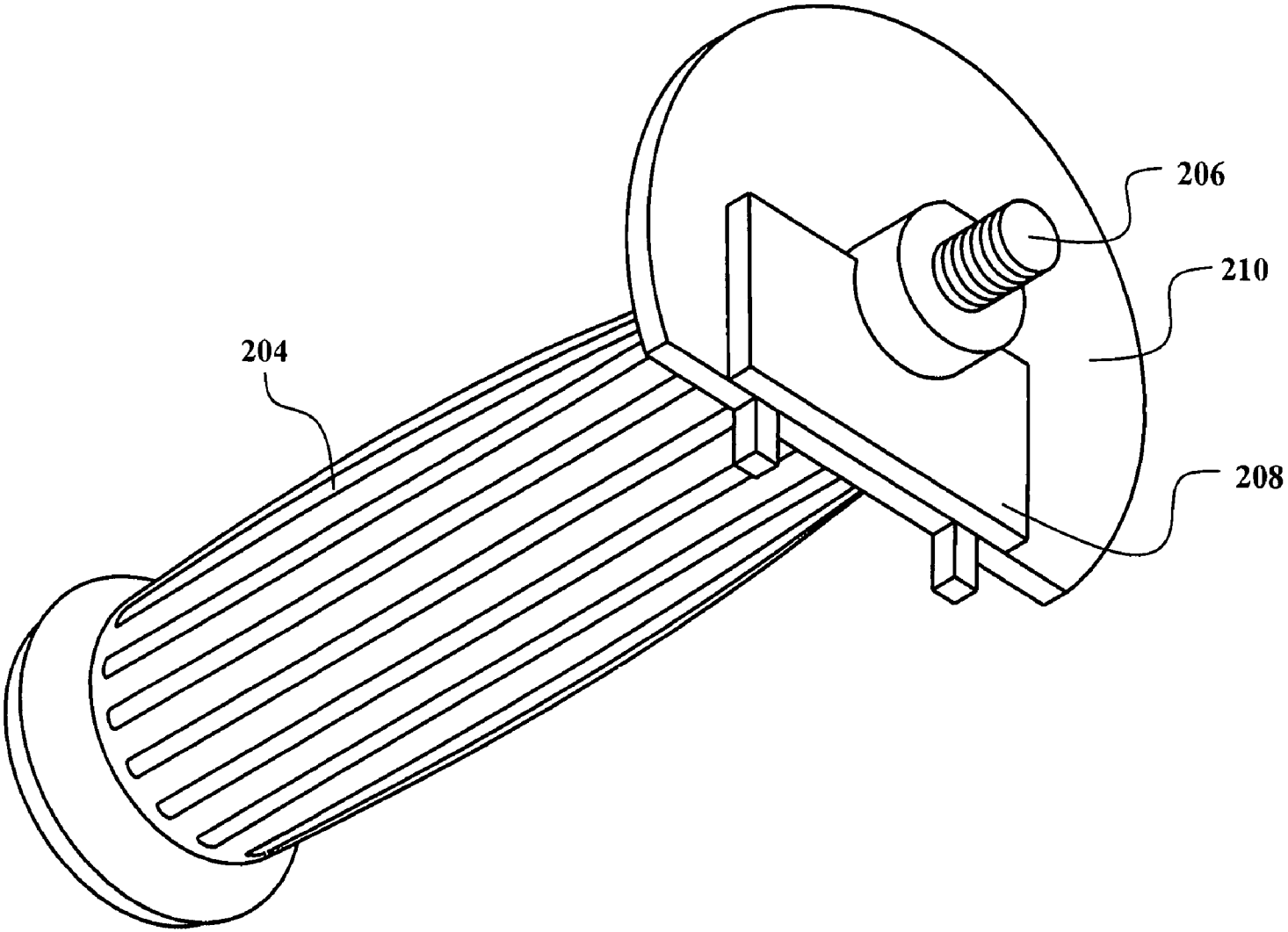
FIG. 2 is a perspective view of a handle assembly including a spanner wrench.

Referring now to FIG. 2, an attachment device is connected to the body 204. For instance, the attachment device is a threaded shaft 206. The handle assembly may be mounted perpendicular to the main body of the hand tool. Preferably the handle assembly is mounted so as to allow the user firm control, such as to avoid kick back and the like. In further embodiments, a guard 210 is included in the handle assembly. For example, a generally circular guard is included adjacent the threaded shaft 206. Additional attachment devices include snap locks, friction locks, bayonet locks and the like for securing the assembly to a hand tool.

The threaded shaft 206 may be received in a threaded aperture included in a motor housing included in a hand tool. For instance, several threaded apertures may be included in a motor housing to allow for various arrangements and overall user comfort. See generally FIG. 1. Moreover, the threaded apertures may be placed to allow for various hand hold positions. Such as to accommodate right and left handed users. In another example, apertures may be included to allow an angle grinder to function as a grinding device, where the handle assembly is mounted generally in the plane of the grinder. In a further example, the handle is mounted perpendicularly and extends out of a plane containing the body of the grinder, in this manner the angle grinder may be used to cut a workpiece.

A mechanical device may be connected to either the body portion 204 or the attachment device. For example, a mechanical device is a spanner wrench head 208. In a further example, a mechanical device such as a spanner head may be connected to a guard 210 included on the handle assembly.

Figure 3:
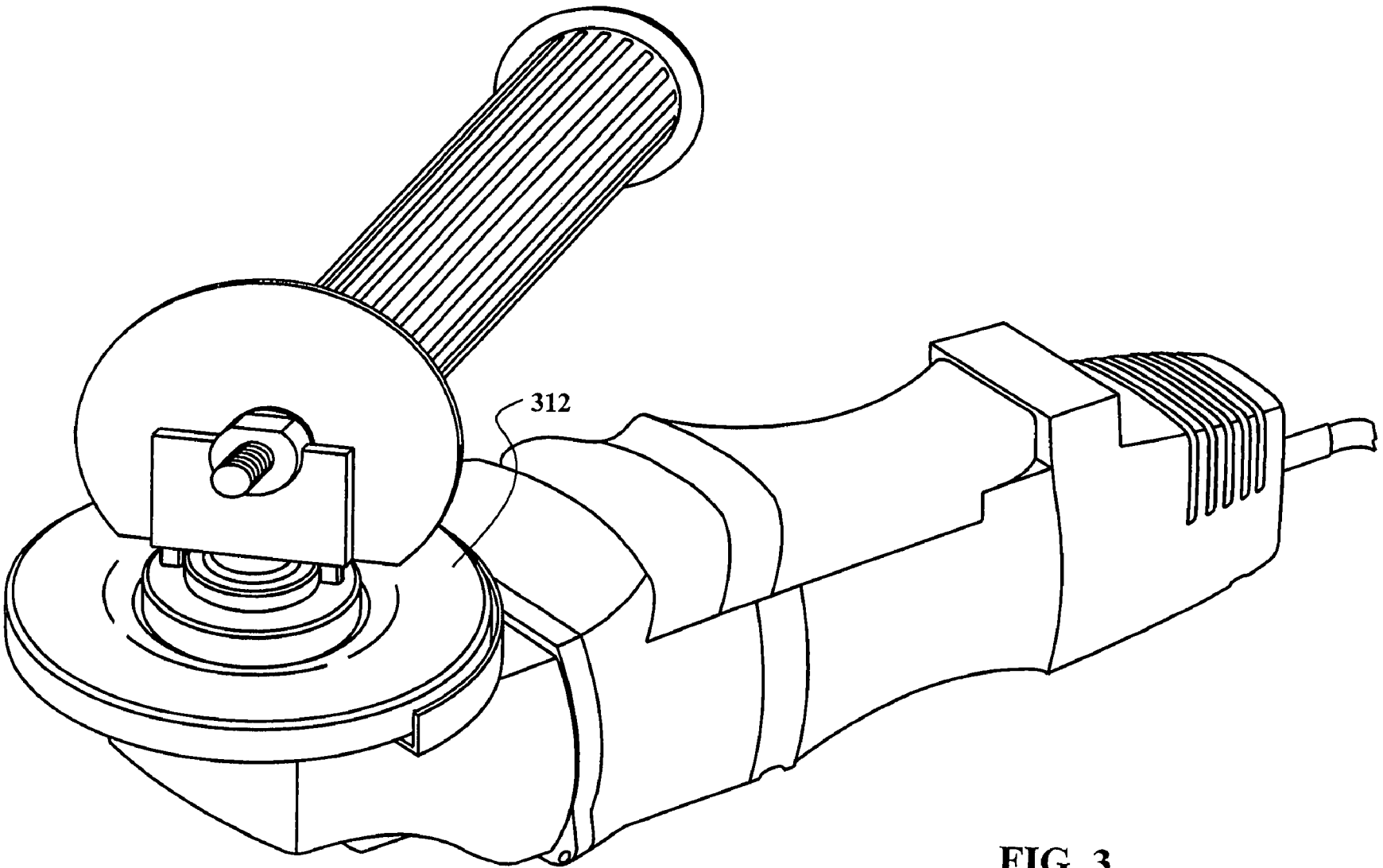
FIG. 3 is an enlarged perspective view of a spanner head included on a handle assembly engaging a securing collar on an angle grinder.

Additional mechanical devices include open-end box wrenches, Allen Wrenches, sockets, chuck keys and the like for manipulating work attachments for a hand-held tool. Referring to FIG. 3, work attachments include bits, blades, such as a composite blade 312, wire brushes, grinding stones, abrasive plates and the like.

Figure 4:
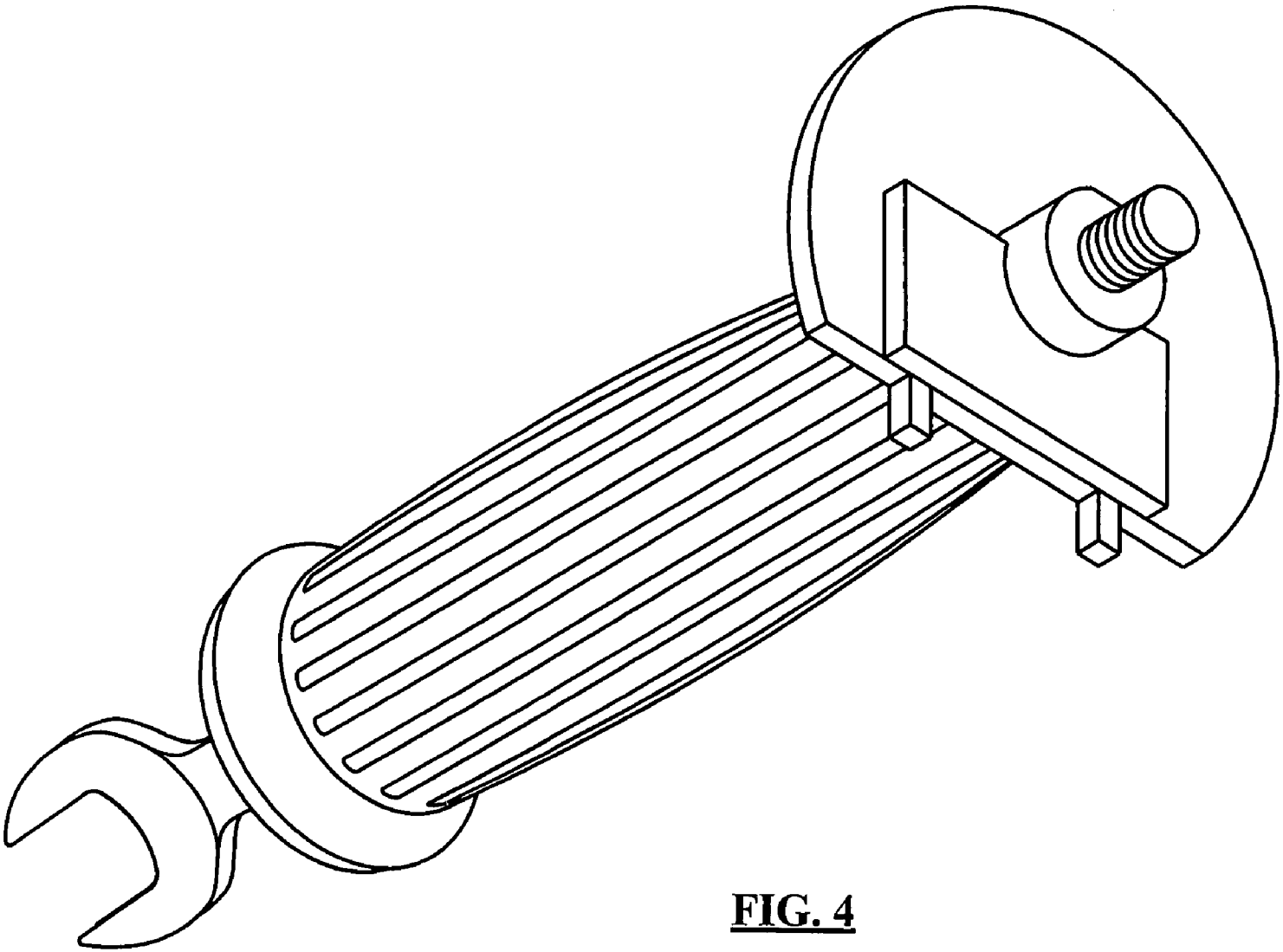
FIG. 4 is a perspective view of a handle assembly including a spanner wrench and an open end box wrench.

For instance, referring generally to FIG. 4, an open end box wrench may be mounted on the end of the body portion generally opposite the attachment device, so as to permit the securing and un-securing of a wire brush having a hex shaped neck portion. Moreover, because a body portion is intended to be grasped, changing work attachments may be easier than previously accomplished with ill designed mechanical devices, such as flat wrenches, often included with hand held tools.

It is believed that the apparatus of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A detachable auxiliary handle assembly, comprising:

a generally cylindrical body suited for grasping;

an attachment device, disposed generally on an end of the generally cylindrical body, said attachment device being configured to attach the handle to a hand-held power tool;

a hand guard disposed adjacent the attachment device on the generally cylindrical body; and a mechanical device connected to the hand guard and spaced from the generally cylindrical body portion, said mechanical device comprising a truncated portion of the hand guard and two projections;

wherein the generally cylindrical body is configured to be held by a user's hand to manipulate the mechanical device which is configured for at least one of securing and un-securing a work attachment to the hand-held power tool.

2. The handle assembly of claim 1, wherein the assembly is a removable auxiliary handle.

3. The handle assembly of claim 1, wherein the attachment device is a threaded shaft which extends coaxially with an axis of said generally cylindrical body portion.

4. The handle assembly of claim 1, wherein the handle assembly is configured for attachment to at least one of a drill, a grinder, and a reciprocating saw.

5. The handle assembly of claim 1, wherein the handle assembly is configured to attach to at least one of a pneumatic angle grinder and an electric angle grinder.

6. The detachable auxiliary handle of claim 1, wherein the mechanical device is a spanner wrench.

7. The detachable auxiliary handle of claim 1, wherein the mechanical device is configured to secure/unsecure at least one of a blade, a brush and a grinding stone.

8. A detachable auxiliary handle, comprising:

a generally cylindrical body configured for being grasped;

a threaded shaft, disposed generally on a first end of the body, said threaded shaft being configured to attach the detachable auxiliary handle into a threaded recess included in an angle grinder;

a hand guard disposed adjacent the threaded shaft on the generally cylindrical body; and a mechanical device connected to the hand guard and spaced from the generally cylindrical body. said mechanical device comprising a truncated portion of the hand quard and two projections; and a spanner wrench connected to a second end of the generally cylindrical body portion, wherein the generally cylindrical body is configured to be held by a user's hand to manipulate the spanner wrench or the mechanical device which are configured for at least one of securing and un-securing a work attachment, and wherein the first end of the body is on a substantially opposite end of the body from the second end of the body.

* * * * *